US008869762B2

(12) United States Patent
Kawamura et al.

(10) Patent No.: US 8,869,762 B2
(45) Date of Patent: Oct. 28, 2014

(54) FLUID-PRESSURE-OPERATED VALVE TIMING CONTROLLER

(71) Applicant: Denso Corporation, Kariya (JP)

(72) Inventors: Futoshi Kawamura, Kariya (JP); Masashi Hayashi, Okazaki (JP); Tadao Ikihara, Okazaki (JP)

(73) Assignee: Denso Corporation, Kariya (JP)

( * ) Notice: Subject to any disclaimer, the term of this patent is extended or adjusted under 35 U.S.C. 154(b) by 80 days.

(21) Appl. No.: 13/766,240

(22) Filed: Feb. 13, 2013

(65) Prior Publication Data

US 2013/0220247 A1 Aug. 29, 2013

(30) Foreign Application Priority Data

Feb. 29, 2012 (JP) ..... 2012-043019

(51) Int. Cl.

| | |
|---|---|
| ***F01L 1/34*** | (2006.01) |
| ***F01L 9/02*** | (2006.01) |
| ***F01L 1/02*** | (2006.01) |
| *F01L 1/344* | (2006.01) |

(52) U.S. Cl.

CPC ..... *F01L 1/3442* (2013.01); *F01L 2001/3443* (2013.01); *F01L 2001/34433* (2013.01)

USPC ..... 123/90.17; 123/90.15; 123/90.31; 123/90.12

(58) Field of Classification Search

CPC ..... F01L 1/3442; F01L 2001/3443; F01L 2001/34433; F01L 2001/33426; F02D 2041/001

USPC ..... 123/90.12, 90.15, 90.17, 90.31

See application file for complete search history.

(56) References Cited

U.S. PATENT DOCUMENTS

| | | | | |
|---|---|---|---|---|
| 5,117,785 | A | 6/1992 | Suga et al. | |
| 8,156,906 | B2 * | 4/2012 | Takenaka | 123/90.17 |
| 8,166,937 | B2 * | 5/2012 | Yamaguchi et al. | 123/90.17 |
| 8,397,687 | B2 * | 3/2013 | Lichti | 123/90.17 |
| 8,534,246 | B2 * | 9/2013 | Lichti et al. | 123/90.17 |
| 8,534,247 | B2 * | 9/2013 | Hori et al. | 123/90.17 |
| 2011/0259289 | A1 * | 10/2011 | Fujiyoshi | 123/90.15 |
| 2012/0060779 | A1 * | 3/2012 | Adachi et al. | 123/90.15 |

FOREIGN PATENT DOCUMENTS

| | | |
|---|---|---|
| JP | 2011-241711 | 12/2011 |
| JP | 2013-064360 | 4/2013 |

OTHER PUBLICATIONS

Office Action (2 pages) dated Feb. 4, 2014, issued in corresponding Japanese Application No. 2012-043019 and English translation (3pages).

* cited by examiner

*Primary Examiner* — Thomas Denion
*Assistant Examiner* — Ngoc T Nguyen
(74) *Attorney, Agent, or Firm* — Nixon & Vanderhye P.C.

(57) ABSTRACT

A fluid-pressure-operated valve timing controller has a control valve that is disposed in a vane rotor and a camshaft. The control valve has a sleeve and a spool moving in an axial direction in the sleeve. The sleeve includes: a valve part held by the vane rotor; a screw part coaxially secured to the camshaft in a state where an axial tension is generated; and a connector part that connects the valve part and the screw part with each other in the axial direction. A strength or rigidity of the connector part relative to the axial tension is lower than that of the valve part.

10 Claims, 8 Drawing Sheets

FLUID-PRESSURE-OPERATED VALVE TIMING CONTROLLER

CROSS REFERENCE TO RELATED APPLICATION

This application is based on Japanese Patent Application No. 2012-43019 filed on Feb. 29, 2012, the disclosure of which is incorporated herein by reference in its entirety.

TECHNICAL FIELD

The present disclosure relates to a fluid-pressure-operated valve timing controller.

BACKGROUND

JP-B2-2760637 (U.S. Pat. No. 5,117,785) describes a fluid-pressure-operated valve timing controller having a housing rotating with a crankshaft and a vane rotor rotating with a camshaft. The vane rotor defines operation chambers inside the housing. The vane rotor is rotated in the circumference direction relative to the housing by working fluid flowing into or out of the operation chambers, thus the rotation phase of the vane rotor relative to the housing is controlled.

The fluid-pressure-operated valve timing controller is equipped with a control valve extending in the vane rotor and the camshaft. The control valve has a sleeve and a spool, and controls the flow of working fluid relative to the operating chambers by controlling the axial movement of the spool in the sleeve. The sleeve has a valve part on the first end in the axial direction and a screw part on the second end in the axial direction. The valve part is held by the vane rotor and accommodates the spool in the slidable state. The screw part is coaxially secured to the camshaft. The sleeve is constructed such manner that the valve part and the screw part are connected with each other in the axial direction, thereby working as a connector connecting the vane rotor to the camshaft. Thus, the number of components for producing the valve timing controller is reduced, and the size of the valve timing controller is made smaller.

However, axial tension generated by securing the screw part to the camshaft may be transmitted to the valve part. If the valve part is deformed, the sliding movement of the spool may be affected, and the control accuracy of the valve timing may be lowered because the controllability of the working fluid by the control valve may be lowered.

SUMMARY

According to an example of the present disclosure, a fluid-pressure-operated valve timing controller that controls a valve timing of an internal combustion engine using a pressure of hydraulic fluid includes a housing, a vane rotor and a control valve. The housing is rotatable synchronously with a crankshaft of the internal combustion engine. The vane rotor is rotatable synchronously with a camshaft of the internal combustion engine, and defines an operating chamber in the housing. A rotation phase of the vane rotor relative to the housing is controlled by a flow of the hydraulic fluid. The control valve is disposed in the vane rotor and the camshaft, and has a sleeve and a spool moving in an axial direction in the sleeve. The control valve controls the flow of the hydraulic fluid relative to the operating chamber by controlling an axial movement of the spool. The sleeve includes a valve part, a screw part and a connector part. The valve part is held by the vane rotor, and the spool is received in the valve part in a slidable state. The screw part is coaxially secured to the camshaft in a state where an axial tension is generated. The connector part connects the valve part and the screw part with each other in the axial direction. The connector part has a strength or rigidity relative to the axial tension, and the strength or rigidity of the connector part is lower than that of the valve part.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
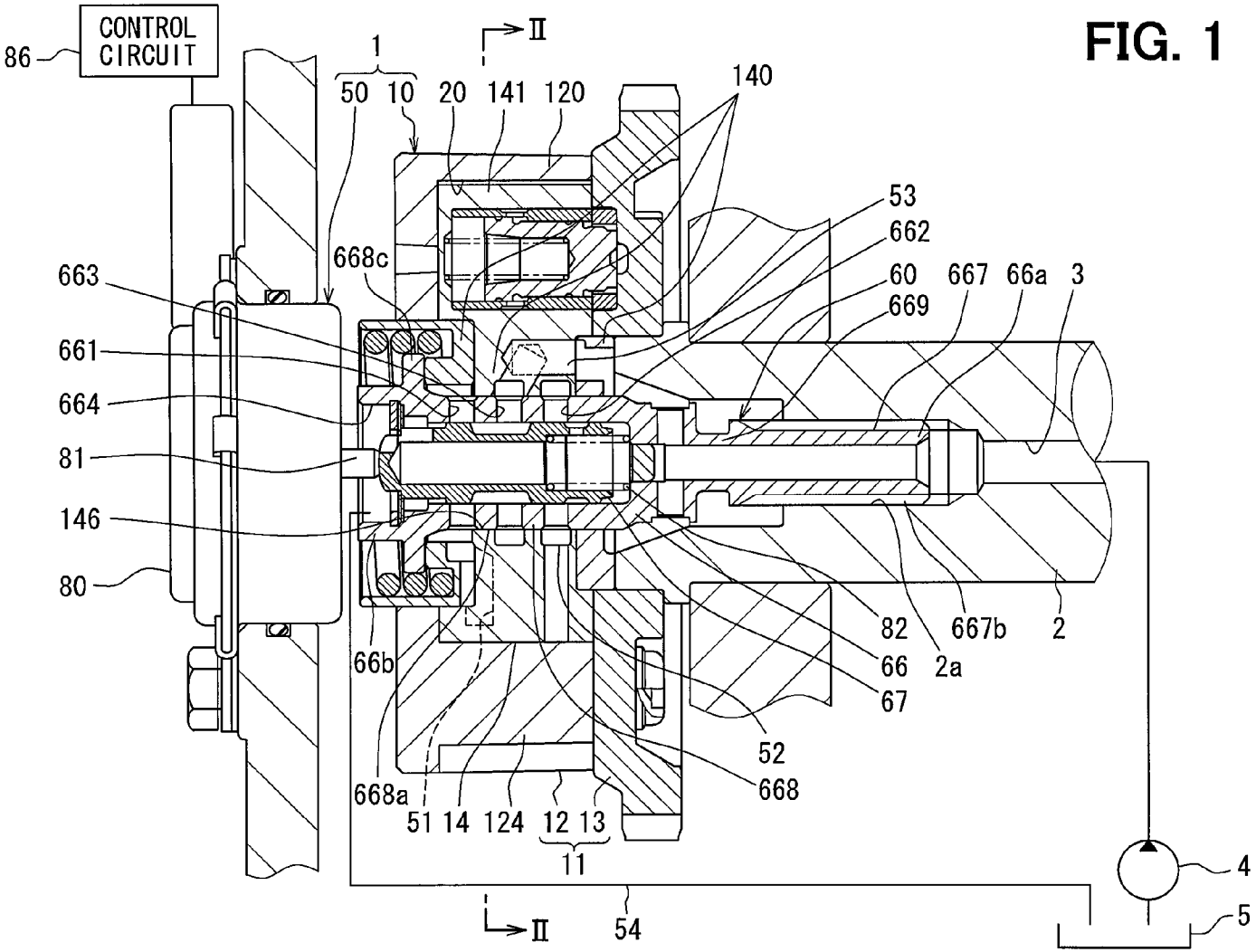
FIG. 1 is a schematic cross-sectional view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A valve timing controller 1 according to a first embodiment is applied to an internal combustion engine for a vehicle, and controls a valve timing of an intake valve using working (hydraulic) fluid such as oil. The valve timing controller 1 has a rotation mechanism system 10 which is disposed in a transmission system, and a control system 50 which controls a flow of the hydraulic fluid so as to drive the rotation mechanism system 10. In the transmission system, a torque of the engine is transmitted to a camshaft 2 from a crankshaft (not shown).

Figure 2:
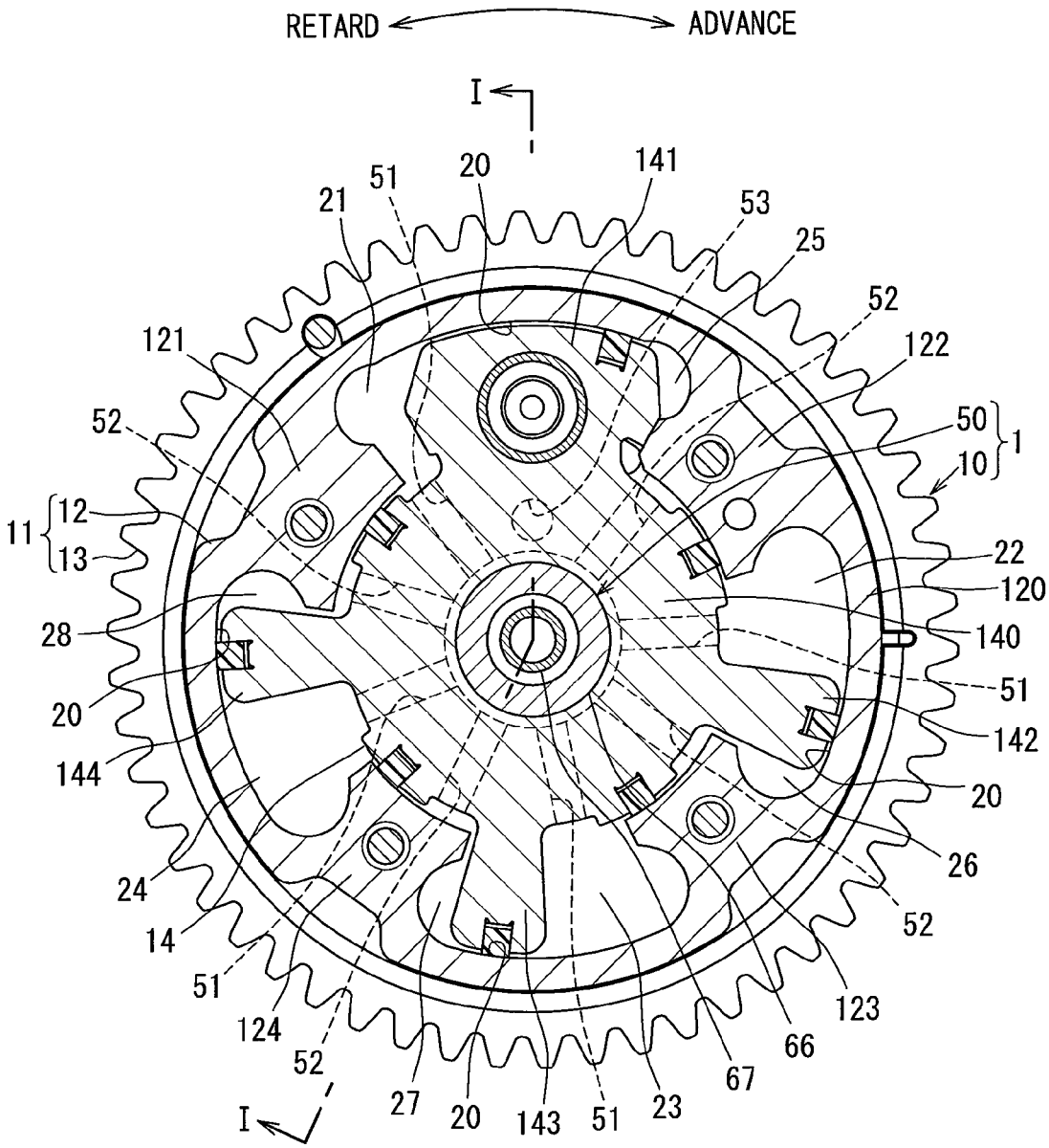
FIG. 2 is a cross-sectional view taken along a line II-II of FIG. 1.

The rotation mechanism system 10 will be described. As shown in FIGS. 1 and 2, a housing 11 of the rotation mechanism system 10 includes a shoe casing 12 having a based cylinder shape and a sprocket plate 13 tightened to an axial open end of the shoe casing 12. A circumference wall of the shoe casing 12 has a housing main part 120 and shoes 121, 122, 123, 124 circumferentially arranged one after another at an equal interval on an inner surface of the housing main part 120 and radially inwardly projecting therefrom. Multiple receiving chambers 20 are defined between the adjacent shoes 121, 122, 123, 124 that are arranged adjacent with each other circumferentially in the rotational direction.

The sprocket plate 13 is connected or linked with the crankshaft via a timing chain (not shown). During an operation of the internal combustion engine, a driving torque is transmitted from the crankshaft to the sprocket plate 13 such that the housing 11 rotates in a clockwise direction in FIG. 2 together with the crankshaft.

A vane rotor 14 is coaxially accommodated in the housing 11. Axial ends of the vane rotor 14 slide on the bottom wall of the housing main part 120 and the sprocket plate 13, respectively. The vane rotor 14 has a rotary shaft 140 and vanes 141, 142, 143, 144. The rotary shaft 140 has a cylindrical shape and is coaxially connected to the camshaft 2. Thus, the vane rotor 14 rotates in the clockwise direction in FIG. 2 (the same direction as the housing 11) together with the camshaft 2, and rotates relative to the housing 11.

The vanes 141, 142, 143, 144 are circumferentially arranged one after another at a generally equal interval on an outer surface of the rotary shaft 140 and radially outwardly projecting therefrom. As shown in FIG. 2, each of the vanes 141, 142, 143, 144 is accommodated in the corresponding chamber 20, thereby defining advance operating chambers 21, 22, 23, 24 and retard operating chambers 25, 26, 27, 28 in the housing 11.

Specifically, the advance operating chamber 21 is defined between the shoe 121 and the vane 141. The advance operating chamber 22 is defined between the shoe 122 and the vane 142. The advance operating chamber 23 is defined between the shoe 123 and the vane 143. The advance operating chamber 24 is defined between the shoe 124 and the vane 144.

Moreover, the retard operating chamber 25 is defined between the shoe 122 and the vane 141. The retard operating chamber 26 is defined between the shoe 123 and the vane 142. The retard operating chamber 27 is defined between the shoe 124 and the vane 143. The retard operating chamber 28 is defined between the shoe 121 and the vane 144.

The rotation mechanism system 10 controls the rotation phase of the vane rotor 14 relative to the housing 11 by the flow of hydraulic fluid with respect to the advance operating chambers 21, 22, 23, 24 and the retard operating chambers 25, 26, 27, 28. Specifically, when the hydraulic fluid is introduced into the advance operating chambers 21, 22, 23, 24, and is discharged from the retard operating chambers 25, 26, 27, 28, the rotation phase is changed in the advance direction. As a result, the valve timing is advanced. On the other hand, when the hydraulic fluid is introduced into the retard operating chambers 25, 26, 27, 28 and is discharged from the advance operating chambers 21, 22, 23, 24, the rotation phase is changed in the retard direction. As a result, the valve timing is retarded.

The control system 50 will be described with reference to FIGS. 1 and 2. An advance passage 51 is formed in the rotary shaft 140, and communicates with the advance operating chambers 21, 22, 23, 24. A retard passage 52 is formed in the rotary shaft 140, and communicates with the retard operating chambers 25, 26, 27, 28. A supply passage 53 is formed in the rotary shaft 140 and a control valve 60 to be described below, and communicates with a pump 4 through a transfer passage 3 penetrating the camshaft 2. The pump 4 is a mechanical pump driven by the engine torque. During the engine rotation, the pump 4 continuously pumps hydraulic fluid from a drain pan 5 to the transfer passage 3 and the supply passage 53. A drain passage 54 is defined outside of the rotation mechanism system 10, and discharges hydraulic fluid to the drain pan 5.

The control valve 60 is a spool type valve having a sleeve 66 and a spool 67. The spool 67 reciprocates in the sleeve 66 in the axial direction, using a driving force generated in a drive direction by energizing a linear solenoid 80 and a restoring force generated by a control spring 82 in an opposite direction opposite from the drive direction.

As shown in FIG. 1, the sleeve 66 of the control valve 60 has an advance port 661, a retard port 662, a supply port 663, and a drain port 664. The advance port 661 communicates with the advance passage 51. The retard port 662 communicates with the retard passage 52. The supply port 663 communicates with the supply passage 53. The drain port 664 communicates with the drain passage 54. The control valve 60 changes the connection state among the ports 661, 662, 663, 664 according to the axial position of the spool 67.

A control circuit 86 is an electronic circuit constructed by a microcomputer etc., and is electrically connected to the linear solenoid 80 and various electronic parts (not shown) of the engine. The control circuit 86 controls the rotation of the engine and the energizing of the linear solenoid 80 according to a computer program memorized in the internal memory.

In the control system 50, the connection state among the ports 661, 662, 663, 664 is changed based on the energizing state of the linear solenoid 80 which is controlled by the control circuit 86. Thus, the flow of hydraulic fluid is controlled relative to the advance operating chambers 21, 22, 23, 24 and the retard operating chambers 25, 26, 27, 28.

A configuration of the control valve 60 will be described in detail.

As shown in FIG. 1, the sleeve 66 made of metal is coaxially received in the vane rotor 14 and the camshaft 2, and extends in the horizontal direction (left-and-right direction in FIGS. 1 and 3) when a vehicle having the controller 1 is located on a horizontal surface. In other words, the sleeve 66 extends from inside of the vane rotor 14 to an inside of the camshaft 2. The sleeve 66 has a first end 66*a* adjacent to the camshaft 2 and a second end 66*b* adjacent to the vane rotor 14 in the axial direction.

Figure 3:
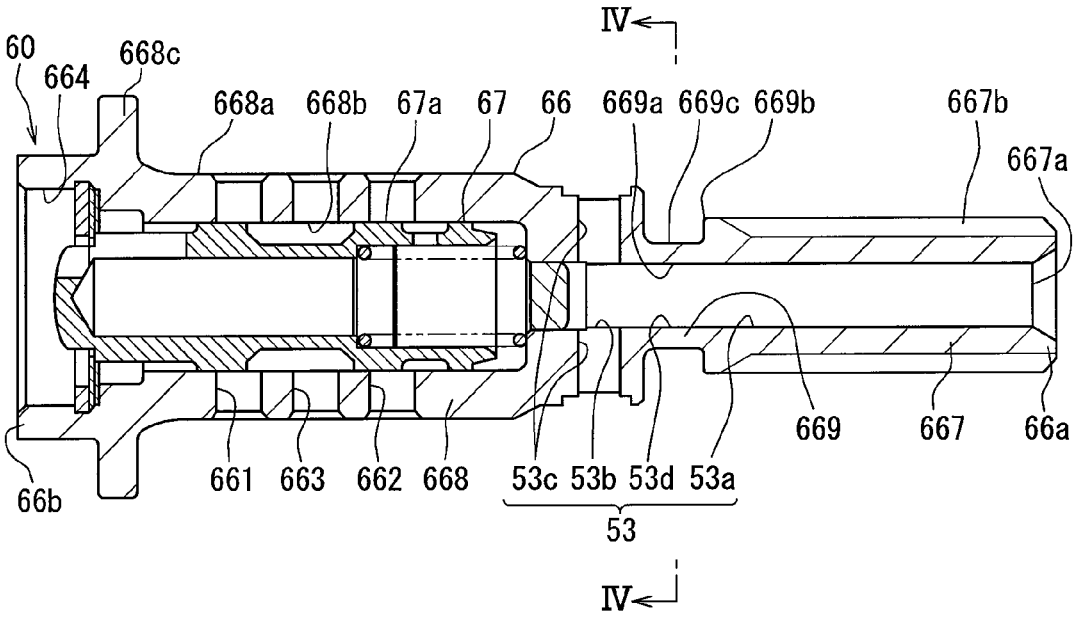
FIG. 3 is a cross-sectional view illustrating a control valve of the valve timing controller of the first embodiment.

As shown in FIG. 3, the sleeve 66 has a screw part 667 adjacent to the first end 66*a*, a valve part 668 adjacent to the second end 66*b*, and a connector part 669 located between the screw part 667 and the valve part 668. The sleeve 66 is made of the same metallic material such as chromium-molybdenum steel in the whole region from the screw part 667 through the connector part 669 to the valve part 668.

As shown in FIG. 3, the screw part 667 has a cylindrical shape extending inside of the camshaft 2. The screw part 667 has an inner circumference hole 667*a* which defines a first part 53*a* of the supply passage 53. The screw part 667 has a male thread 667*b* which is coaxially secured to a female thread 2*a* of the camshaft 2. An axial tension is generated when the male thread 667*b* of the screw part 667 is secured to the camshaft 2.

The valve part 668 has a cylindrical shape which accommodates the spool 67 in the slidable state. An outer circumference surface 668*a* of the valve part 668 is coaxially held by an inner circumference hole 146 of the vane rotor 14.

As shown in FIG. 3, an outer circumference surface 67*a* of the spool 67 slidingly contacts an inner circumference hole 668*b* of the valve part 668, and the inner circumference hole 668*b* of the valve part 668 defines a second part 53*b* of the supply passage 53 by the portion which does not accommodate the spool 67.

Figure 4:
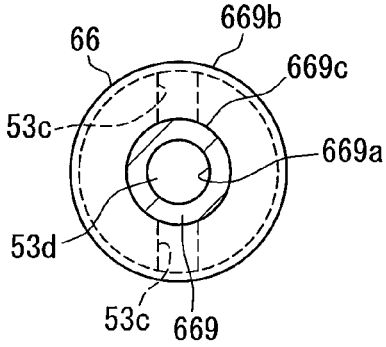
FIG. 4 is a cross-sectional view taken along a line IV-IV of FIG. 3.

Moreover, each of the ports 661, 662, 663 (except the port 664) passes through the valve part 668 in the radial direction. As shown in FIG. 4, a third part 53*c* of the supply passage 53 also passes through the valve part 668 in the radial direction. Furthermore, the valve part 668 has a contact portion 668*c* having a ring flange shape projected outward in the radial direction all around the circumference direction.

As shown in FIG. 1, the contact portion 668*c* is in contact with the vane rotor 14 with the surface contact state from the opposite side opposite from the connector part 669 in the axial direction. Due to the contact state, the camshaft 2 and the vane rotor 14 are connected with each other through the sleeve 66 in the axial direction in the state where the vane rotor 14 is interposed between the contact portion 668*c* and the camshaft 2 to which the screw part 667 is secured.

As shown in FIG. 3, the connector part 669 has the cylindrical shape which connects the valve part 668 to the screw part 667 to have the same axis. An inner circumference hole 669*a* of the connector part 669 forms a fourth part 53*d* of the supply passage 53.

As shown in FIGS. 3 and 4, the connector part 669 has a concave portion 669*c* which is recessed inward in the radial direction from the outer circumference surface 669*b*. In the present embodiment, the concave portion 669*c* is formed in the ring groove shape which continues to extend all around the circumference direction.

By the formation of the concave portion 669*c*, the cross-sectional area (for example, hatching area in FIG. 4) of the connector part 669 is set smaller than the minimum value of the cross-sectional area of the valve part 668 and the minimum value of the cross-sectional area of the screw part 667. Here, the minimum value of the cross-sectional area of the valve part 668 is a cross-sectional area of a portion which forms either of the ports 661, 662, 663, or a cross-sectional area of a portion which forms the third part 53*c* of the supply passage 53. Moreover, the minimum value of the cross-sectional area of the screw part 667 is a cross-sectional area of the bottom portion of the male thread 667*b*.

Thus, in the present embodiment, the connector part 669 has a strength (hardness) for plastic-deformation relative to an assumption axial tension generated at the securing time, and the strength of the connector part 669 is lower than that of the valve part 668 and the screw part 667. In addition, the assumption axial tension represents a real axial tension which is adjusted at an actual securing time so as to plastically deform only the connector part 669, or an axial tension generated by an erroneous load to plastically deforms only the connector part 669 in a case where the real axial tension is adjusted.

Advantages of the first embodiment will be explained below.

The valve part 668 supported by the vane rotor 14 and the screw part 667 coaxially secured to the camshaft 2 are connected with each other in the axial direction by the connector part 669. The connector part 669 has the strength relative to the assumption axial tension generated when the screw part 667 is secured to the camshaft 2, and the strength of the connector part 669 is lower than the strength of the valve part 668. Therefore, at the securing time, the connector part 669 has plastic deformation prior to the valve part 668.

The connector part 669 has the priority of the plastic deformation to the valve part 668 not only when the real axial tension actually deforms the connector part 669, but also when a load which is larger than the critical axial tension is applied accidentally while the real axial tension is less than the critical axial tension.

Because the connector part 669 has the deformation in advance to the valve part 668, the valve part 668 is restricted from having deformation, so the sliding of the spool 67 in the valve part 668 can be less affected. Therefore, it becomes possible to set the sliding clearance between the sleeve 66 and the spool 67 as the minimum, and to raise the controllability of the hydraulic fluid by the control valve 60 and the control accuracy of the valve timing.

The vane rotor 14 is supported between the camshaft 2 and the contact portion 668*c* of the valve part 668 which contacts the vane rotor 14 from the opposite side from the connector part 669 in the axial direction. In a comparison example, the valve part 668 may incline to the axis direction of the camshaft 2 depending on the manufacturing tolerances. If the valve part 668 is not allowed to incline to the screw part 667 which is secured to the camshaft 2, the valve part 668 may be deformed and the sliding of the spool 67 will be affected.

However, according to the first embodiment, the connector part 669 has a bending rigidity which is lower than that of the screw part 667 and the valve part 668. Therefore, the connector part 669 is deformed (bent) between the screw part 667 and the valve part 668, at the securing time. Thus, the inclination of the valve part 668 is permitted, so the sliding of the spool 67 can be smoothly achieved by restricting the deformation of the valve part 668. As a result, the valve timing can be accurately controlled.

Furthermore, the connector part 669 of the first embodiment has the concave portion 669*c* which is dented in the radial direction from the outer circumference surface 669*b*, such that the cross-sectional area of the connector part 669 is made smaller than that of the valve part 668 and the screw part 667. Thus, the strength of the connector part 669 relative to the axial tension can be certainly made small rather than that of the valve part 668 and the screw part 667.

Moreover, due to the concave portion 669*c* of the connector part 669, the flexural rigidity can be certainly made lower than that the valve part 668 and the screw part 667, because the second moment of area is made smaller than that of the valve part 668 and the screw part 667. Accordingly, at the securing time, the connector part 669 has plastic deformation with high priority rather than the valve part 668 and the screw part 667, the sliding of the spool 67 is less affected. Thus, the control accuracy of the valve timing can be raised with reliability.

Second Embodiment

Figure 5:
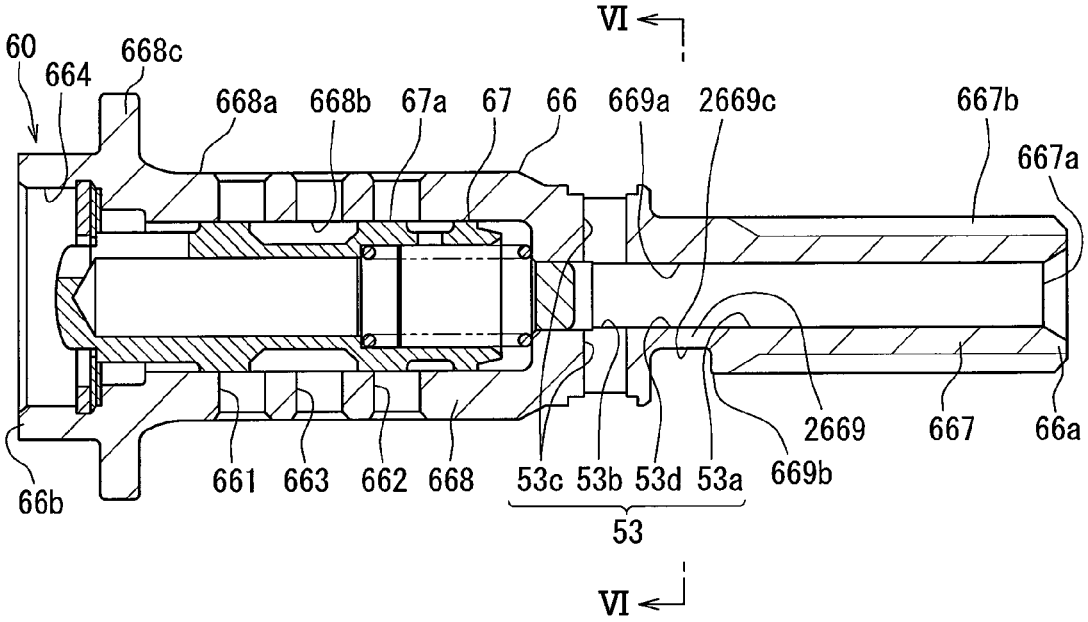
FIG. 5 is a cross-sectional view illustrating a control valve of a valve timing controller according to a second embodiment.
Figure 6:
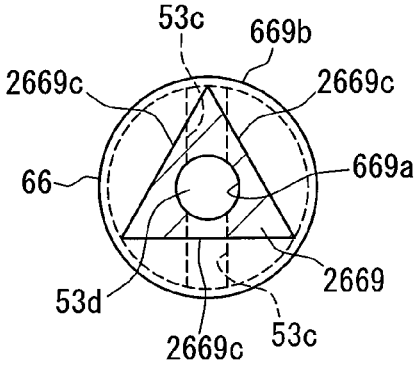
FIG. 6 is a cross-sectional view taken along a line VI-VI of FIG. 5.

A second embodiment will be described with reference to FIGS. 5 and 6. A connector part 2669 of the second embodiment has a concave portion 2669*c* which is recessed inward in the radial direction from the outer circumference surface 669*b*. The concave portion 2669*c* is defined at plural positions with a regular interval in the circumference direction, and has a hollow groove shape.

According to the second embodiment, the cross-sectional area of the connector part 2669 is set smaller than the cross-sectional area of the valve part 668 and the screw part 667, by forming the concave portion 2669*c*. Therefore, the strength of the connector part 2669 with respect to the assumption axial tension is smaller certainly rather than that of the valve part 668 and the screw part 667. Thus, approximately the same advantages can be obtained as the first embodiment.

Third Embodiment

Figure 7:
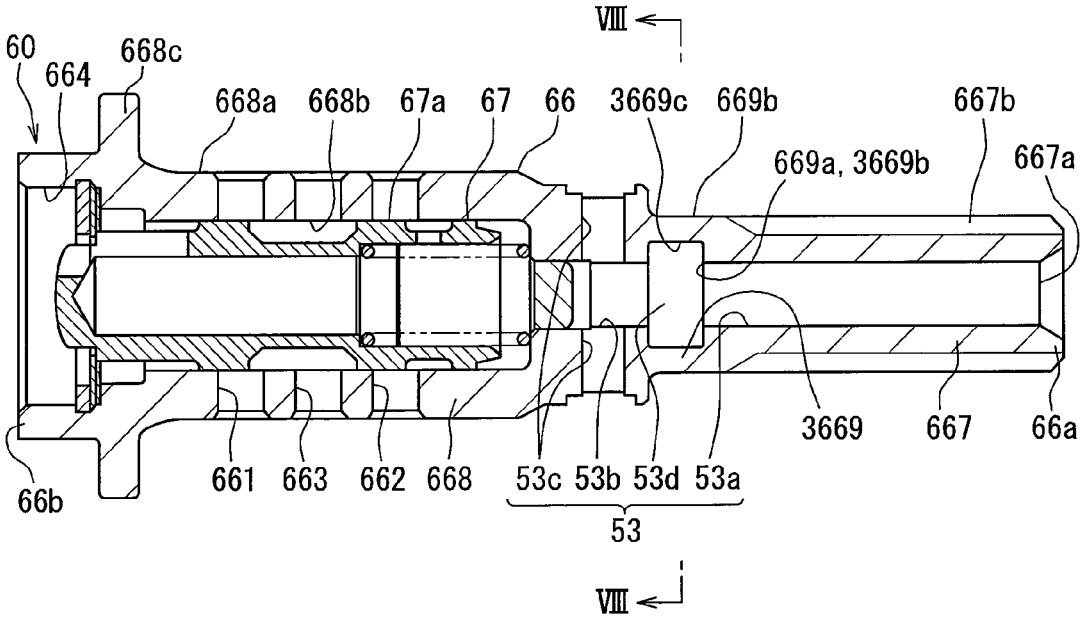
FIG. 7 is a cross-sectional view illustrating a control valve of a valve timing controller according to a third embodiment.
Figure 8:
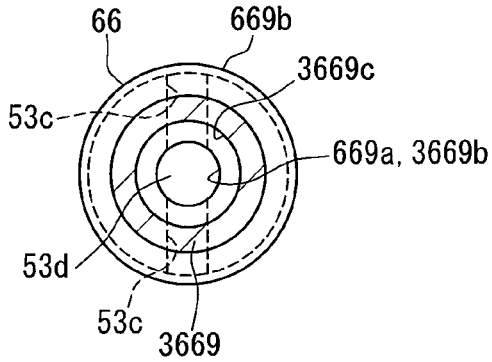
FIG. 8 is a cross-sectional view taken along a line VIII-VIII of FIG. 7.

A third embodiment will be described with reference to FIGS. 7 and 8. A connector part 3669 of the third embodiment has a concave portion 3669*c* which is recessed outward in the radial direction from an inner circumference surface 3669*b* of the inner circumference hole 669*a*. The concave portion 3669*c* is formed continuously to extend all around the circumference direction with the ring groove shape. Alternatively, similarly to the second embodiment, the concave portion 3669*c* may be formed at plural positions with the hollow groove shape.

According to the third embodiment, the cross-sectional area of the connector part 3669 is set smaller than the cross-sectional area of the valve part 668 and the screw part 667, by forming the concave portion 3669*c*. Therefore, the strength of the connector part 3669 with respect to the assumption axial tension is smaller certainly rather than that of the valve part 668 and the screw part 667. Thus, approximately the same advantages can be obtained as the first embodiment.

Fourth Embodiment

Figure 9:
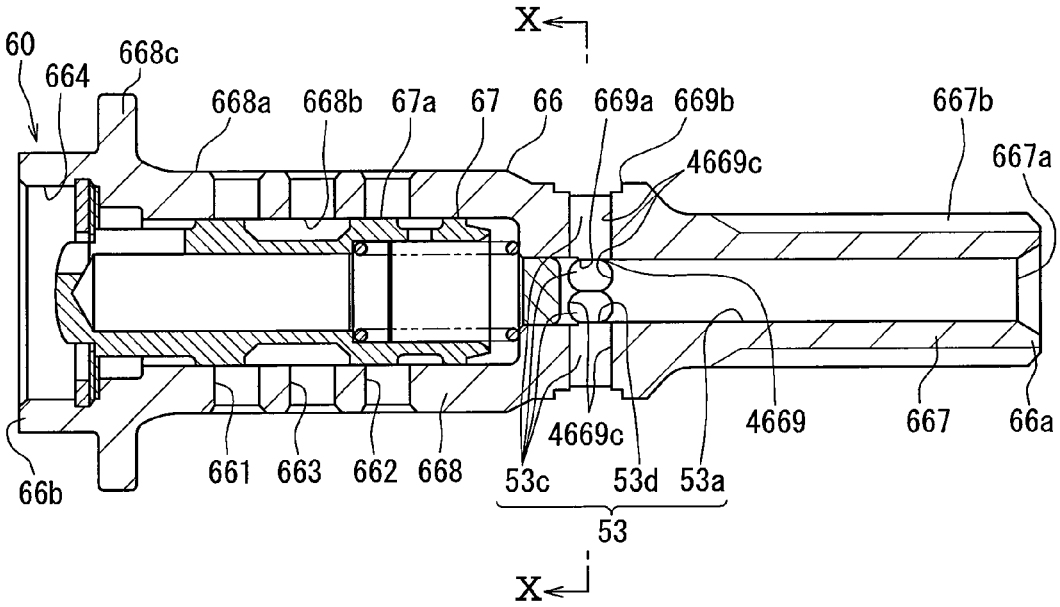
FIG. 9 is a cross-sectional view illustrating a control valve of a valve timing controller according to a fourth embodiment.
Figure 10:
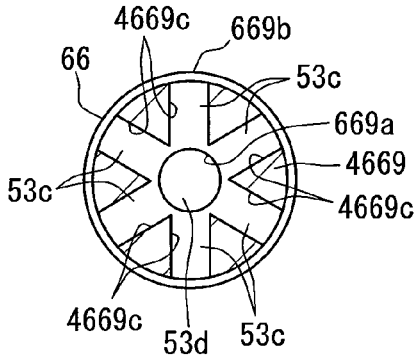
FIG. 10 is a cross-sectional view taken along a line X-X of FIG. 9.

A fourth embodiment will be described with reference to FIGS. 9 and 10. In the fourth embodiment, the third part 53*c* of the supply passage 53 is formed in a connector part 4669 instead of the valve part 668. That is, the connector part 4669 has a through hole 4669*c* which corresponds to the third part 53*c* of the supply passage 53 instead of the concave portion 669. The number of the through holes 4669*c* (the third part 53*c* of the supply passage 53) is larger than that of the first embodiment. Each of the through holes 4669*c* has a cylindrical hole shape, and passes through the connector part 4669 in the radial direction. The through holes 4669*c* are located with a regular interval in the circumference direction.

According to the fourth embodiment, the cross-sectional area of the connector part 4669 is set smaller than the cross-sectional area of the valve part 668 and the screw part 667, by forming the through hole 4669*c*. Therefore, the strength of the connector part 4669 with respect to the assumption axial tension is smaller certainly rather than that of the valve part 668 and the screw part 667. Thus, approximately the same advantages can be obtained as the first embodiment.

Fifth Embodiment

A fifth embodiment will be described with reference to FIGS. 11 and 12. In the fifth embodiment, a connector part 5669 has the third part 53*c* of the supply passage 53 which is constructed by the combination of the concave portion 3669*c* of the third embodiment and the through holes 4669*c* of the fourth embodiment. Each of the through holes 4669*c* extends between the outer circumference surface 669*b* of the connector part 5669 and a bottom face 5669*c* of the concave portion 3669*c* in the radial direction.

According to the fifth embodiment, due to the combination of the concave portion 3669*c* and the plural through holes 4669*c*, the cross-sectional area of the connector part 5669 is set smaller than the cross-sectional area of the valve part 668 and the screw part 667. Therefore, the strength of the connector part 5669 with respect to the assumption axial tension is smaller certainly rather than that of the valve part 668 and the screw part 667. Thus, approximately the same advantages can be obtained as the first embodiment.

Figure 11:
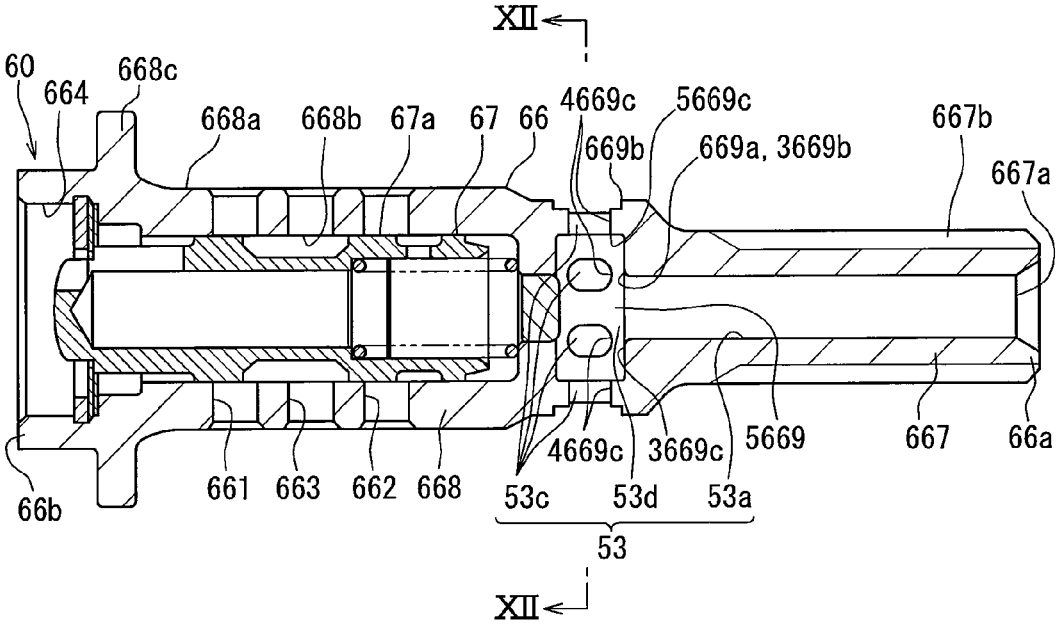
FIG. 11 is a cross-sectional view illustrating a control valve of a valve timing controller according to a fifth embodiment.
Figure 12:
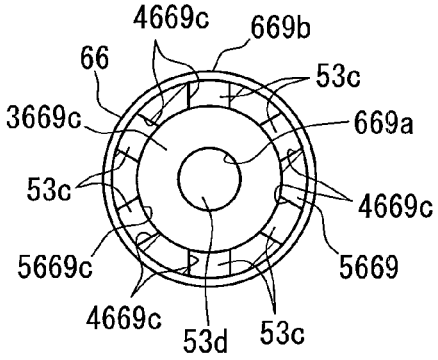
FIG. 12 is a cross-sectional view taken along a line XII-XII of FIG. 11.

Alternatively, the through hole 4669*c* of the fourth embodiment may be combined with the concave portion 669*c* of the first embodiment, or the plural concave portions 2669*c* of the second embodiment, instead of the concave portion 3669*c* of the third embodiment, according to the structure shown in FIGS. 11 and 12.

Modification for the First to Fifth Embodiments

Instead of lowering the strength of the connector part 669, 2669, 3669, 4669, 5669, the rigidity of the connector part 669, 2669, 3669, 4669, 5669 relative to the assumption axial tension may be made lower than that of the valve part 668 and the screw part 667. In other words, the spring constant of the connector part 669, 2669, 3669, 4669, 5669 may be made lower than the spring constant of the valve part 668 and the screw part 667 by forming the concave portion 669*c*, 2669*c*, 3669*c* and/or the through hole 4669*c* as shown in FIGS. 3-12.

In this case, the assumption axial tension generated at the securing time is set within a predetermined elastic region so as not to cause plastic deformation for the connector part 669, 2669, 3669, 4669, 5669, the valve part 668, and the screw part 667. According to such modification, the connector part 669, 2669, 3669, 4669, 5669 can have elastic deformation prior to the valve part 668 and the screw part 667. Therefore, the advantages similar to the first embodiment can be obtained by replacing the plastic deformation with the elastic deformation.

Sixth Embodiment

Figure 13:
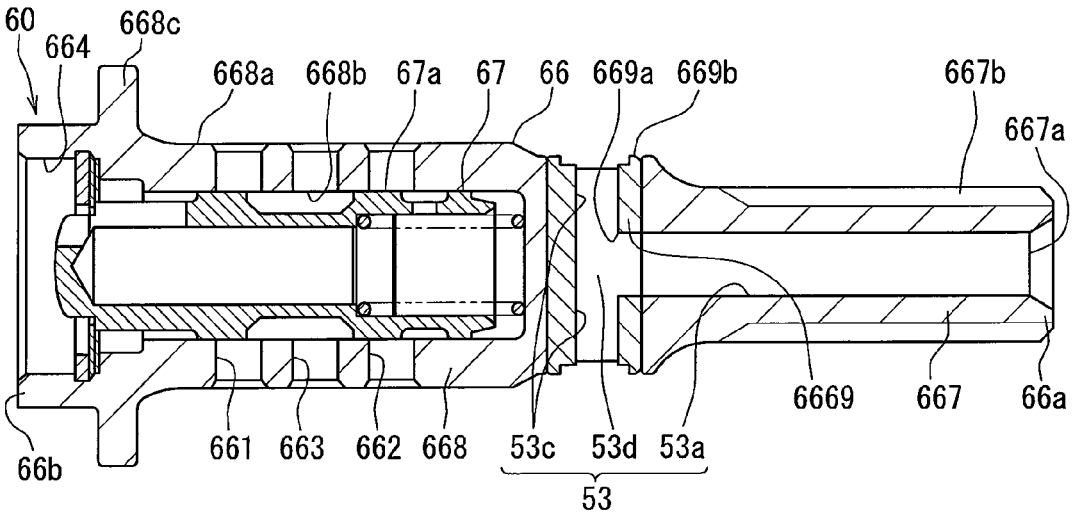
FIG. 13 is a cross-sectional view illustrating a control valve of a valve timing controller according to a sixth embodiment.

As shown in FIG. 13, a connector part 6669 of a sixth embodiment is made of a material different from the valve part 668 and the screw part 667. Specifically, the connector part 6669 may be made of metallic material such as copper alloy whose longitudinal elastic modulus (Young's modulus) is lower than that of the valve part 668. The connector part 6669 is joined to the valve part 668 and the screw part 667 with the strength not to separate from depending on the axial tension at the securing time.

The spring constant of the connector part 6669 is set lower than the spring constant of the valve part 668 and the screw part 667 by adopting such metallic material having lower longitudinal elastic modulus, thereby the rigidity of the connector part 6669 is made lower than the rigidity of the valve part 668 and the screw part 667. Here, the axial tension generated at the securing time is set in a predetermined elastic region not to cause the plastic deformation for the connector part 6669, the valve part 668, and the screw part 667. Therefore, at the securing time, the connector part 6669 is elastically deformed in prior to the valve part 668 and the screw part 667.

Thus, the valve part 668 is restricted from being deformed by the axial tension or inclination, so the spool 67 can slide smoothly in the valve part 668. Further, the screw part 667 is restricted from being deformed, so the control valve 60 can be securely attached to the camshaft 2 through the screw part 667, similarly to the first embodiment. Therefore, the control accuracy of the valve timing can be raised with reliability.

In the sixth embodiment, the third part 53*c* of the supply passage 53 is formed in the connector part 6669 with the same number as the first embodiment, and corresponds to a through hole. Alternatively, the third part 53*c* of the supply passage 53 may be formed in the valve part 468 similarly to the first embodiment.

The concave portion 669*c*, 2669*c*, 3669*c* and/or the through hole 4669*c* is not defined in the connector part 6669 in the sixth embodiment. However, in the case where the third part 53*c* of the supply passage 53 is formed in the valve part 468, if the concave portion 669*c*, 2669*c*, 3669*c* and/or the through hole 4669*c* is defined in the connector 6669, the advantages described in the modification for the first to fifth embodiment may also be obtained.

Furthermore, in the first to fifth embodiment, the strength of the connector part 669, 2669, 3669, 4669, 5669 relative to the assumption axial tension may be made lower than the valve part 668 or the screw part 667 by performing heat treatment etc. to the valve part 668 or the screw part 667.

The present application is not to be limited to the above embodiments, but may be implemented in other ways without departing from the sprit of the present application. The present application may be applied also to a valve timing controller which controls valve timing of an exhaust valve instead of the intake valve, and a valve timing controller which controls valve timings of the intake valve and the exhaust valve.

Such changes and modifications are to be understood as being within the scope of the present disclosure as defined by the appended claims.

What is claimed is:

1. A fluid-pressure-operated valve timing controller that controls a valve timing of an internal combustion engine using a pressure of hydraulic fluid comprising:

a housing that is rotatable synchronously with a crankshaft of the internal combustion engine;

a vane rotor that is rotatable synchronously with a camshaft of the internal combustion engine and defines an operating chamber in the housing, a rotation phase of the vane rotor relative to the housing being controlled by a flow of the hydraulic fluid; and a control valve that is disposed in the vane rotor and the camshaft, the control valve having a sleeve and a spool moving in an axial direction in the sleeve, the control valve controlling the flow of the hydraulic fluid relative to the operating chamber by controlling an axial movement of the spool, wherein the sleeve includes:

a valve part held by the vane rotor, the spool being received in the valve part in a slidable state;

a screw part coaxially secured to the camshaft in a state where an axial tension is generated; and a connector part that connects the valve part and the screw part with each other in the axial direction, the connector part having a strength or rigidity relative to the axial tension, the strength or rigidity of the connector part being lower than that of the valve part.

2. The fluid-pressure-operated valve timing controller according to claim 1, wherein the valve part has a contact portion contacting the vane rotor from an opposite side opposite from the connector part in the axial direction, the vane rotor is interposed between the contact portion and the camshaft in the axial direction, and the connector part has a bending rigidity which is lower than that of the valve part.

3. The fluid-pressure-operated valve timing controller according to claim 1, wherein the strength or rigidity of the connector part relative to the axial tension is lower than that of the screw part.

4. The fluid-pressure-operated valve timing controller according to claim 1, wherein the strength of the connector part relative to the axial tension is lower than that of the valve part, and the connector part is in a plastic deformation state when the axial tension is applied.

5. The fluid-pressure-operated valve timing controller according to claim 1, wherein the rigidity of the connector part relative to the axial tension is lower than that of the valve part, and the connector part is in an elastic deformation state when the axial tension is applied.

6. The fluid-pressure-operated valve timing controller according to claim 4, wherein the connector part has a cross-sectional area perpendicular to the axial direction, and the cross-sectional area of the connector part is smaller than that of the valve part.

7. The fluid-pressure-operated valve timing controller according to claim 6, wherein the connector part has a circumferential surface and a concave portion recessed in a radial direction from the circumferential surface.

8. The fluid-pressure-operated valve timing controller according to claim 6, wherein the connector part has a through hole penetrated in the radial direction.

9. The fluid-pressure-operated valve timing controller according to claim 5, wherein the connector part has a spring constant which is lower than that of the valve part.

10. The fluid-pressure-operated valve timing controller according to claim 9, wherein the connector part is made of a material having a longitudinal elastic modulus which is lower than that of the valve part.

* * * * *